United States Patent [19]

Smrt

[11] 4,126,273

[45] Nov. 21, 1978

[54] ACTUATOR AND ACTUATOR-ORIENTATOR ASSEMBLY FOR AEROSOL SPRAY CANS

[76] Inventor: Thomas J. Smrt, 31W 300 W. Bartlett Rd., Bartlett, Ill. 60103

[21] Appl. No.: 770,840

[22] Filed: Feb. 22, 1977

[51] Int. Cl.[2] ..... B05B 15/06

[52] U.S. Cl. ..... 239/579; 222/181; 239/597; 403/14

[58] Field of Search ..... 239/150, 337, 287, 579, 239/597, 599, 601; 222/181, 610; 285/24, 27; 403/13, 14

[56] References Cited

U.S. PATENT DOCUMENTS

| | | | |
|---|---|---|---|
| 2,062,806 | 12/1936 | Casler | 285/27 X |
| 3,306,252 | 2/1967 | Knight et al. | 239/337 X |
| 3,924,784 | 12/1975 | Smrt | 239/601 X |

FOREIGN PATENT DOCUMENTS

| | | | |
|---|---|---|---|
| 2,358,513 | 5/1974 | Fed. Rep. of Germany | 239/337 |

*Primary Examiner*—John J. Love

*Assistant Examiner*—Michael J. Forman

[57] ABSTRACT

An actuator and actuator-orientator assembly orients aerosol cans in the proper position to spray a stripe of marking material. An actuator having a generally cylindrical outer surface is adapted to be mounted on the valve stem of an aerosol can and includes a spraying orifice and a pair of radially outwardly extending locating lugs. The actuator-orientator is provided with a circular central opening into which the actuator is inserted and a pair of recesses which extend radially outwardly from the central opening for receiving the locating lugs of the actuator when the actuator is properly oriented. The periphery of the central opening is defined by curved guide surfaces which extend upwardly from the recesses. A guide surface extends from each side of each recess and meets a guide surface from the other recess at the midpoint of the arc which extends between the recesses. When the actuator is inserted downwardly into the opening of the orientator and the lugs engage the guide surfaces, the actuator and aerosol can move downwardly and rotate along the guide surfaces until the lugs are seated within the recesses.

6 Claims, 8 Drawing Figures

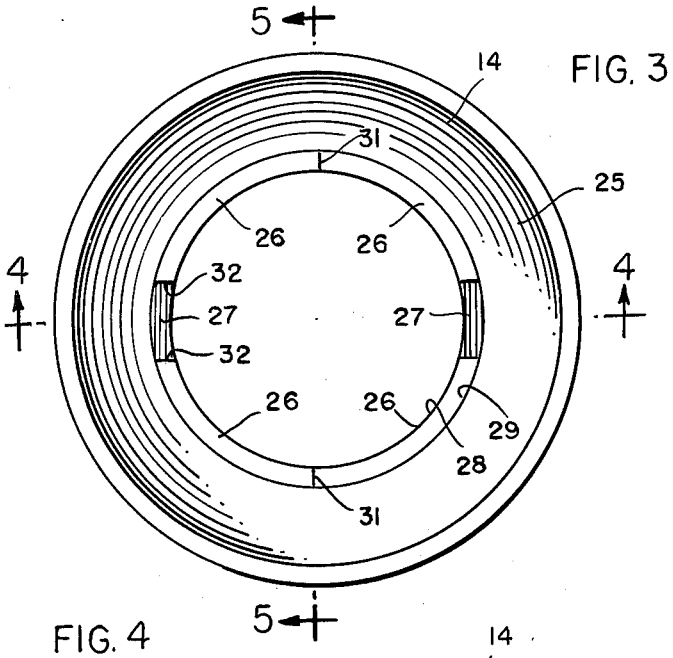
FIG. 3
FIG. 4
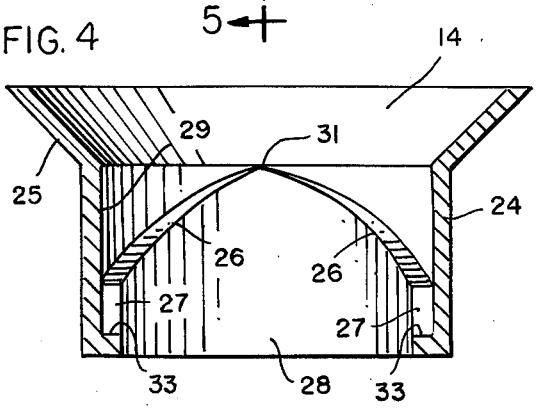
FIG. 5
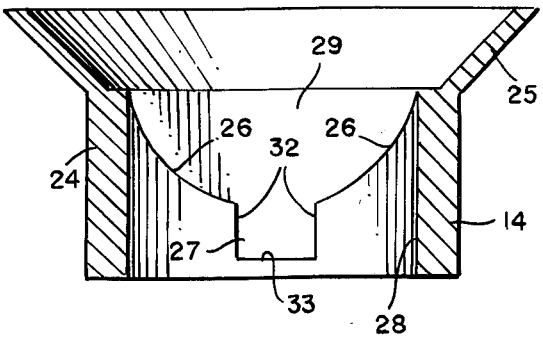
FIG. 6
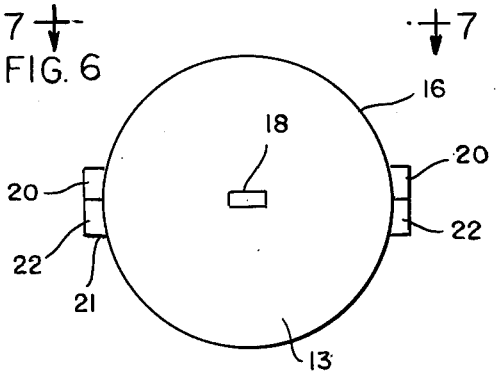
FIG. 7
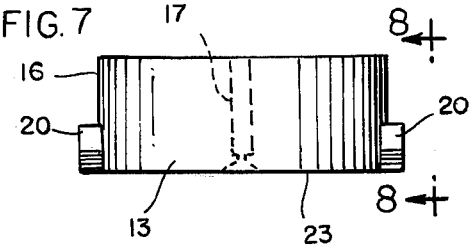
FIG. 8
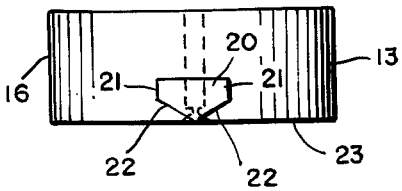

ACTUATOR AND ACTUATOR-ORIENTATOR ASSEMBLY FOR AEROSOL SPRAY CANS

BACKGROUND AND SUMMARY

This invention relates to aerosol spray cans, and, more particularly, to an actuator and actuator-orientator assembly which automatically orientates the actuator when it is inserted into the orientator so that the spraying orifice of the actuator is properly aligned.

Aerosol spray cans which are filled with marking materials such as paints, dyes, and the like are frequently used in marking traffic and parking lines on pavement, boundary lines on athletic fields, restricted areas on golf courses, and many other indicators. If an aerosol can is to be used for spraying a stripe of marking material, it is often desirable to provide the actuator or nozzle of the aerosol can with an elongated or slotted spraying orifice so that the material is sprayed in a well-defined stripe of the desired width. The aerosol cans are desirably mounted in a spraying apparatus which facilitates the marking operation. Wheel-equipped marking machines for spraying stripes are described, for example, in my prior U.S. Pat. Nos. 3,700,144 and 3,796,353, and hand-carried marking devices are described in my U.S. Pat. Nos. 3,485,206 and 3,977,570. Actuators with elongated or slotted spraying orifices are described in U.S. Pat. Nos. 3,817,429, 3,891,208, and 3,924,784.

If an actuator with an elongated spraying orifice is used, the actuator should be aligned with respect to the spraying apparatus so that the long dimension of the orifice extends perpendicularly to the direction in which the apparatus is advanced in order to make the widest possible stripe. In order to make the narrowest stripe, the long dimension of the orifice is aligned parallel with the direction of movement of the apparatus. Variations in stripe width between these two extremes are possible by varying the angle between the long dimension of the orifice and the direction of movement of the apparatus. One type of stripe-adjusting means is described in U.S. Pat. No. 3,924,784.

U.S. Pat. Nos. 3,817,429 and 3,891,128 describe an actuator with a flat aligning surface which is engageable with the actuating bar which slides transversely relatively to the axis of the aerosol can to align the elongated orifice of the actuator in a direction perpendicular to the direction of movement of the spraying apparatus. The actuating bar opens the valve of the aerosol can by moving the actuator.

The invention provides an actuator for an aerosol can and a means for orientating the actuator when the actuator is inserted into the orientator. The orientator may be mounted as part of the spraying apparatus, and the orifice of the actuator is automatically aligned as the actuator is inserted into the orientator.

DESCRIPTION OF THE DRAWING

Invention will be explained in conjunction with an illustrative embodiment shown in the accompanying drawing, in which --

FIG. 3 is a top plan view of the orientator;

FIG. 4 is a sectional view of the orientator taken along the line 4—4 of FIG. 3;

FIG. 5 is a sectional view of the orientator taken along line 5—5 of FIG. 3;

FIG. 6 is a top plan view of the actuator;

FIG. 7 is a side elevational view of the actuator taken along the line 7—7 of FIG. 6:

FIG. 8 is a side elevational view of the actuator taken along the line 8—8 of FIG. 7.

DESCRIPTION OF SPECIFIC EMBODIMENT

Figure 1:
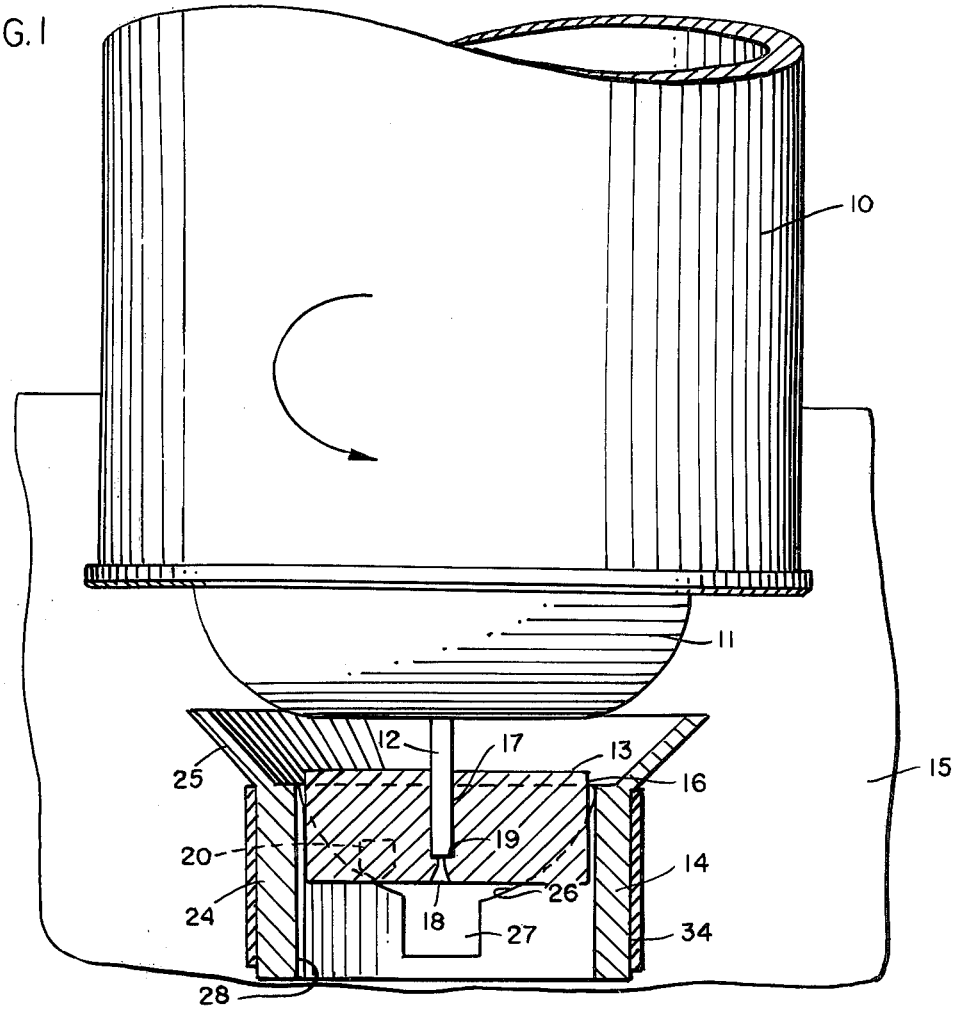
FIG. 1 is a fragmentary elevational view showing an actuator on an aerosol can being inserted downwardly into an orientator formed in accordance with the invention.
Figure 2:
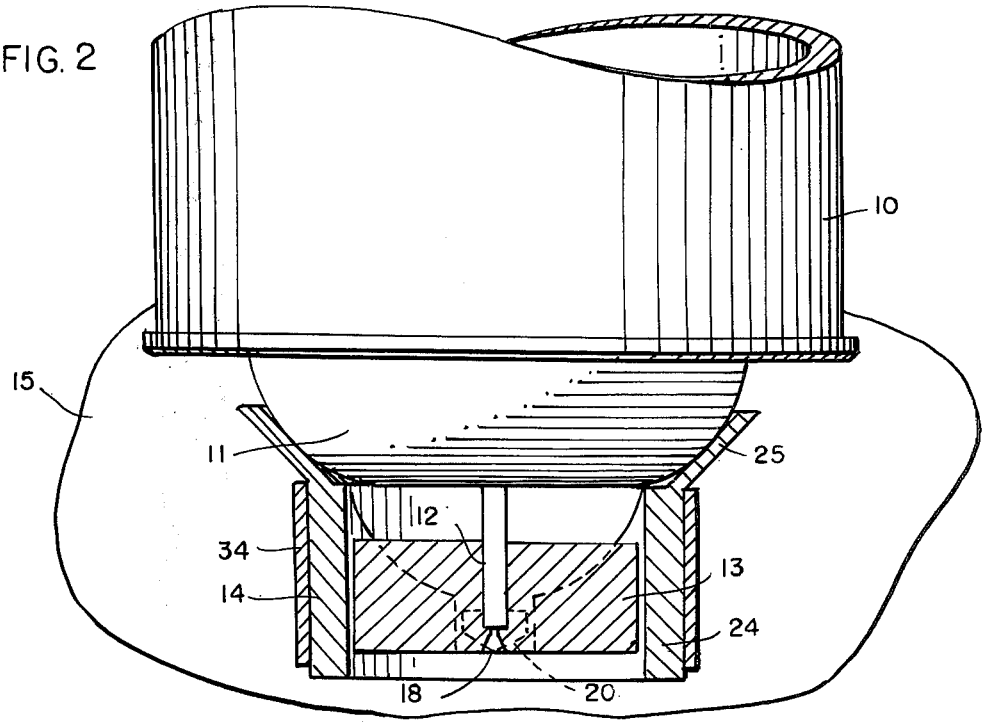
FIG. 2 is a view similar to FIG. 1, showing the actuator fully inserted into the orientator.

Referring to FIGS. 1 and 2, a conventional aerosol spray can includes a dome-shaped top 11 and a valve stem 12. The valve stem is part of a well known conventional aerosol valve which is housed within the top of the can.

Aerosol valves are generally of two types. In one type of valve the valve is opened to release the contents of the can when the valve stem is pushed axially with respect to the can (upwardly as viewed in FIGS. 1 and 2). In another type the valve is opened when the valve stem is tilted laterally or transversely with respect to the can axis. Although the invention can be used with aerosol valves of both types, the invention works best with valves which are opened by pushing the valve stem axially.

An actuator or spraying nozzle 13 is mounted on the valve stem and is adapted to be inserted into an orientator 14, which is mounted on a spraying apparatus 15. The actuator has a circular outer wall 16 (FIG. 6), and a central bore 17 (FIG. 1) is sized to snugly receive the valve stem 12. The bore terminates in a spraying orifice 18, and a radially inwardly extending shoulder 19 in the bore engages the end of the valve stem and limits the movement of the actuator toward the can.

As can be seen in FIG. 6, the spraying orifice is elongated or rectangular and includes a long dimension and a short dimension. A pair of locating lugs 20 project outwardly from the surface 16 and are aligned with the longitudinal dimension of the spraying orifice. Each of the lugs includes a pair of parallel flat side surfaces 21 (FIG. 8) and a pair of convergent surfaces 22 which meet at the flat end surface 23 in which the spraying orifice 18 is provided.

The orientator 14 includes a generally tubular wall 24 and a radially outwardly flared upper portion 25. By comparing FIGS. 4 and 5, it will be seen that about half the thickness of the tubular wall of the orientator is recessed or notched to provide curved or spiral guide surfaces 26 and a pair of diametrically opposed rectangular recesses 27. The non-recessed portion of the tubular wall forms a cylindrical inner surface 28, and the recessed portion of the tubular wall forms an intermediate cylindrical surface 29. The distance between the cylindrical surfaces 20 and 29 provides the thickness of the guide surfaces 26, which appear annular when viewed from above (FIG. 3).

The orientator includes a total of four guide surfaces 26. Referring to FIG. 5, two guide surfaces spiral upwardly from each side of each of the recesses 27, and guide surfaces which extend from the diametrically opposed recesses meet at a point 31 midway along the arc which extends between the two recesses (FIG. 4), i.e., at a point 90° removed from the centers of the recesses.

Each of the recesses 27 includes a pair of side surfaces 32 (FIG. 5) and a bottom surface 33 which is provided by the full thickness of the tubular wall 24. The distance between the side surfaces 32 is just slightly greater than the distance between the flat side surfaces 21 of the lugs on the actuator.

The orientator is mounted on the spraying apparatus 15 in any convenient fashion. For example, the actuator can be clamped in a split-ring clamping collar 34 (FIGS. 1 and 2) on the spraying apparatus, and the collar can be tightened about the orientator by a nut and bolt. The particular spraying apparatus illustrated is adapted to spray the contents of the aerosol can downwardly, so the aerosol can is mounted in the apparatus in an inverted position. The aerosol can does not include a dip tube, and the contents of the can are expelled by the aerosol propellant when the can is in an inverted position.

When the aerosol can is moved downwardly toward the orientator, the actuator on the can is guided into the central opening of the orientator by the flared upper end 25 of the orientator. The diameter of the cylindrical side surface 16 of the actuator is slightly less than the diameter of the inner cylindrical surface 28 of the orientator, and the maximum diameter of the actuator across the lugs 20 is slightly less than the diameter of the intermediate cylindrical surface 29 of the orientator. Accordingly, the lugs will engage the curved guide surfaces 26 of the orientator unless the lugs are aligned with the recesses 27. The weight of the can will cause the lugs to slide downwardly along the curved guide surfaces toward the recesses as indicated by the arrow in FIG. 1, and the can and the actuator will rotate as they move downwardly to bring the lugs into alignment with the recesses. When the lugs reach the recesses, the lugs will drop into the recesses, and further rotation of the actuator will be prevented.

After the lugs are positioned in the recesses, the contents of the can may be sprayed by pushing the can downwardly so that the valve stem is moved axially upwardly relative to the can. The bottom surface 33 of each of the recesses engages the lug and prevents downward movement of the actuator and the valve stem when the can is pushed downwardly. The can may be pushed downwardly either manually or by mechanical actuating means on the spraying apparatus. Alternatively, the can could be fixed against upward movement, and the orientator and actuator could be pushed upwardly to open the valve.

The recesses of the orientator orient the spraying orifice of the actuator so that the long dimension of the orifice extends in the desired direction. If a stripe of maximum width is desired, the recesses are aligned transversely to the direction in which the spraying apparatus will be advanced so that the long dimension of the spraying orifice is also aligned transversely when the lugs of the actuator are positioned in the recesses. If a stripe of minimum width is desired, the recesses are aligned parallel to the direction the spraying apparatus will be advanced so that the long dimension of the spraying orifice is also aligned parallel to the direction of movement. Variations in stripe width between the maximum and minimum can be obtained by positioning the orientator accordingly. The orientator is desirably mounted on the spraying apparatus in a manner which permits the orientator to be rotated to align the recesses in the desired direction. For example, the clamping collar 34 can be loosened when it is desired to rotate the orientator and tightened after the orientator has been positioned as desired.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. In a spraying apparatus for spraying the contents of a spray can, an actuator and orientator assembly for orienting the spray can in a desired spraying position comprising:

(a) an orientator having a generally cylindrical wall providing an opening through which the contents of the can are sprayed, a pair of radially outwardly extending recesses in the cylindrical wall for receiving portions of the actuator, and at least one guide surface which extends from each of the recesses in a spiral direction relative to the central axis of the cylindrical wall; and (b) an actuator having an elongated spraying orifice through which the contents of the spray can are sprayed, the actuator having a body which has a width approximately equal to the diameter of said cylindrical wall of the orientator and a pair of projections which extend from the body and which are engageable with the guide surfaces of the orientator when the actuator is inserted into the opening of the orientator and which are sized and arranged to be received by the recesses of the orientator for positioning the actuator relative to the orientator.

2. The structure of claim 1 in which the body of the actuator has a generally cylindrical outer surface and the pair of projections extend radially outwardly from the cylindrical outer surface of the body at generally diametrically opposed locations.

3. The structure of claim 2 in which the projections are aligned with the long dimension of the spraying orifice.

4. The structure of claim 1 in which a pair of guide surfaces spiral away from each of said recesses in opposite directions.

5. The structure of claim 4 in which each of the guide surfaces which spiral away from one of the recesses meets one of the guide surfaces which spiral away from the other recess.

6. The structure of claim 1 in which the orientator includes a cylindrical surface which is concentric with said cylindrical wall and which is positioned radially outwardly of the guide surfaces.

* * * * *